United States Patent [19]

Menges et al.

[11] Patent Number: 4,932,307

[45] Date of Patent: Jun. 12, 1990

[54] BELTFEEDER FOR AN AUTOMATIC GAS PRESSURE LOADED WEAPON IN PARTICULAR A MACHINE CANNON

[76] Inventors: Horst Menges, Schwalbenweg 17, 403 Ratingen 8; Norbert Schenk, Wörthstr. 13, 4 Duesseldorf, both of Fed. Rep. of Germany

[21] Appl. No.: 374,646

[22] Filed: May 4, 1982

Related U.S. Application Data

[63] Continuation-in-part of Ser. No. 255,843, Apr. 20, 1981, abandoned.

[30] Foreign Application Priority Data

Apr. 19, 1980 [DE] Fed. Rep. of Germany ..... 3015130

[51] Int. Cl.[5] ..... F41D 10/32

[52] U.S. Cl. ..... 89/33.04; 89/33.25

[58] Field of Search ..... 89/33 BC, 33 CA, 33.16, 89/33.25, 33.04

[56] References Cited

U.S. PATENT DOCUMENTS

| | | | |
|---|---|---|---|
| 2,375,219 | 5/1945 | Gentry et al. . | |
| 3,650,175 | 3/1972 | Colby | 89/33 CA |
| 4,273,025 | 6/1981 | Bremer et al. | 89/33 CA |
| 4,416,185 | 11/1983 | Schenk | 89/33 SF |

FOREIGN PATENT DOCUMENTS

| | | | |
|---|---|---|---|
| 1807929 | 6/1969 | Fed. Rep. of Germany . | |
| 2430002 | 1/1976 | Fed. Rep. of Germany | 89/33 CA |
| 1063272 | 4/1954 | France . | |
| 619756 | 3/1949 | United Kingdom | 89/33 BC |

*Primary Examiner*—Stephen C. Bentley
*Attorney, Agent, or Firm*—Klein & Vibber

[57] ABSTRACT

An ammunition belt feeding device for a machine cannon is driven by branched off gas via a gas piston cartridges are alternatively fed by two transport wheels from two sides into a loading chamber of the machine cannon. Two feed star sprocket wheels are operatively connected to two feed shafts rotatably mounted in a housing of the weapon and operatively engage the ammunition belts fed from two sides so as to alternatively feed from each ammunition belt into the loading chamber. A pair of locking pawls in the form of two-armed levers are pivotally mounted in the housing of the weapon and coact with the pair of sprocket wheels. In a first embodiment of the invention a coil spring for each locking pawl is operatively connected to one arm of the two-armed lever so as to urge to other arm towards the sprocket wheel. In both embodiments of invention a pinion wheel having a cam surface is also coaxially mounted on each feed shaft and its cam surface coacts with the other arm of the two-armed lever. In the first embodiment a control pin for each pinion wheel is slidably mounted in the housing of the weapon and is disposed between the pinion wheel and the other arm of the two-armed lever. In the second embodiment of the invention the cam surface of the pinion wheel and the two-armed lever are constructed so that the coil spring and control arm can be dispensed with.

6 Claims, 8 Drawing Sheets

BELTFEEDER FOR AN AUTOMATIC GAS PRESSURE LOADED WEAPON IN PARTICULAR A MACHINE CANNON

CROSS REFERENCE TO RELATED APPLICATION

This application is a continuation-in-part application of our co-pending application, Ser. No. 255,843, filed on Apr. 20, 1981 and entitled BELTFEEDER OF AN AUTOMATIC GAS PRESSURE LOADED WEAPON, IN PARTICULAR A MACHINE CANNON, now abandoned.

BACKGROUND OF THE INVENTION

The invention relates to a belt feeder for an automatic gas pressure loaded-weapon, in particular a machine cannon.

Such a belt feeder and its drive is, for example, disclosed in German published unexamined patent application No. 2,809,505 (corresponding to U.S. Pat. No. 4,273,025). With this known belt feeder there may occur a jamming of a cartridge by the feed shaft sprocket wheel after completion of the transporting phase of the belt feeder and thereby its discharge through the breech is hindered. Thereby the cartridge can be damaged during discharge and an increased load is placed on the feed shaft sprocket wheel and, due to this, a lowering of the firing cadence may occur. These drawbacks do particularly strongly manifest themselves when, during firing the end of the belt is reached or is nearly reached, because then there still is exerted the same forces of the drive mechanism on the reduced mass of the ammunition belt.

In our co-pending application Ser. No. 255,843 there is described a recoil brake for a feed shaft sprocket wheel which is required for transporting the ammunition belt. This recoil brake limits at the end of the belt the rotation of the corresponding sprocket wheel shaft by having a locking pawl engage a cam affixed to the shaft in a jerky fashion. The engagement, respectively disengagement of the locking pawl is effected in accordance with the teachings of the previously mentioned patent application by means of a control pin which engages a cam surface of the drive gear which is actually slidably displacable in the housing of the arrangement. In practice it has however been established that the force which is transferred from the spring via the locking pawl to the control pin produces friction between the control pin and the driving gear and during the axial movement friction between the control pin and the housing. As a consequence of this, the frictional forces can influence and produce malfunctioning and thereby lower the firing cadence of the weapon. During the return rotation of the driving gear the control pin moves the locking pawl out of the engagement position. This can make it possible that when a long ammunition belt is used, due to its mass moment of inertia the ammunition belt may trailingly slip which has the effect that the ratchet wheel impacts against the ratchet point of the locking pawl which moves out of its safety position and this can also cause an excessive wear.

SUMMARY OF THE INVENTION

It is a general object of this invention to provide a belt-feeder for an automatic gas pressure loaded weapon in which the aforedescribed drawbacks are avoided.

An inhibition of the firing cadence due to the influence of frictional forces is to be avoided and malfunctioning, caused by excessive wear, primarily at the ratchet points of the locking pawl, but also in the guiding arrangement for the control pin, is avoided.

It has now been recognized that in an ammunition belt feeding arrangement, in particular of the type described in our copending application, Ser. No. 255,843, the aforedescribed drawbacks can be avoided in that the spring force which causes the friction is dispensed with and the engagement time period of the locking pawl engaging into the gaps between the ratchet teeth of the ratchet wheel is prolonged.

Thus there is provided for the transport gear wheel of a transport shaft a recoil brake, in which frictional forces and wear during the engagement and disengagement of the ratchet wheel have no longer any significant effect, because the locking pawl directly engages respectively disengages, by means of thereto rigidly connected two lever arms, which move simultaneously in and out in accordance with the movement of the driving gear in a controlled manner as a result of slidingly engaging control cam surfaces which are disposed on the driving gear, into the gaps between the ratchet teeth of the ratchet wheel, without causing any frictional forces worth mentioning. The use of a control pin and its guidance in accordance with the first embodiment of the invention as described in the aforementioned copending application is thereby dispensed with.

A particularly advantageous construction in accordance with the second embodiment of the invention includes that a premature disengagement of the locking pawls from the safety position in the ratchet wheel is avoided, because a lever arm, which is arranged at the locking pawl during the return rotation of the driving gear, is disengaged by sliding over a longer region of the control cam having the diameter D to thereby disengage the locking pawl in a time-delayed manner.

Further advantageous constructional features result from that the lever arm is arranged at the locking pawl in a space saving manner and the locations of contact with the drive gear and the ratchet wheel are not subject to wear and operate in a specially friction-free manner.

Due to the time delayed disengagement of the locking pawl relative to the return rotation of the driving gear by way of the forced sequence of movement of the lever arms via the control cams and the high wear resistance, in particular of the ratchet points of the locking pawls, there is avoided that particularly long ammunition belts slip because the time delay of the post-slip of the belt is reduced in such a way that a flaw-free operation with a high cadence is made possible.

In the aforedescribed first embodiment it sometimes occurs that frictional forces are produced which are transferred by the spring 7 via the locking pawl 4 onto the control pin 3A, such frictional forces being also produced between the control pin 3A and the drive pinion 1, and also a frictional force is engendered during the actual movement between the control pin 3A and the housing. As a result, these frictional forces may cause malfunctioning and a decrease in the firing cadence. During return movement of the drive pinion the control pin 3A moves the locking pawl lever arm out of its meshed position. This may bring about that when a long ammunition belt is being fed due to its mass moment of inertia there is a trailing slipping of the belt which causes the ratchet wheel to impact against the two armed lever and, as it moves out of its safety position, causes excessive wear between the impacting parts.

Some of these drawbacks are avoided or mitigated by means of the second embodiment of the invention illustrated in FIGS. 5 to 10. In particular the drawback of the reduction of the firing cadence due to frictional wear is avoided or mitigated and malfunctioning caused by such wear is avoided or mitigated in particular at the ratchet point as well as at the portion which guides the control rod.

There is also achieved by the second embodiment a complete dispensing of the spring which acts on the locking pawl which further minimizes the wear caused by friction; moreover the engagement time of the locking pawl in the gaps between ratchet teeth of the ratchet wheel is prolonged. By means of such an embodiment there is provided for the transporting gear wheels at each feed shaft a recoil brake, which has no significant effects during the frictional engagement and causes no significant wear at the engagement and disengagement of the ratchet wheel because the locking pawl, by means of the two lever arms originally connected thereto, is controlled by the movements of the drive pinions due to the simultaneous engagement and disengagement of the control cams disposed on the drive pinion in forced sequence without producing significant frictional forces, which engagement is directed into the gaps between the ratchet teeth of the ratchet wheel. Thus the requirement of using a control rod (see FIGS. 1 to 3) and the means for guiding the control rod is completely dispensed with.

A particularly advantageous construction results from the fact that a premature disengagement of the locking pawl from the safety position of the ratched wheel is prevented, because a lever arm arranged at the locking pawl is disengaged by the return rotation of the drive pinion by gliding over a longer glide region of the control cam having the diameter D so that the locking pawl is disengaged in a time-delayed manner.

Another advantageous feature of the second embodiment resides in that the lever arms forming part of the locking pawl are configured in a space-saving manner and that the contact points with the drive pinion and the ratched wheel are contructed in a wear-resistant way and function in a particularly friction-free manner.

There is avoided, due to the fact that relative to the return rotation of the driving pinion a time-delayed disengagement of the locking pawl is achieved in view of the forced sequence of pivotal movements of the lever arms along the control cams and the high wear resistance of the locking pawl, in particular at the points of the ratched teeth, so that especially with long ammunition belts which tend to trailingly slip due to the time delay of the trailing slip-pulse of the belt, this slipping is reduced to such an extent that a flawfree operation with a high firing cadence is made possible.

BRIEF DESCRIPTION OF THE DRAWING

With these and other objects in view, which will become more apparent in the following detailed description, the present invention is shown by way of example only and will be clearly understood in conjunction with the accompanying drawing, in which:

FIGS. 1 to 4 illustrate a first embodiment and FIGS. 5 to 10 illustrate a second embodiment of the recoil brake of the invention.

FIG. 2 is a vertical sectional view through line 2—2 of the feed shaft illustrated in FIG. 1A;

FIG. 3 is a vertical sectional view along lines 3—3 of FIG. 1A;

FIG. 4 is a plan sectional view along lines 4—4 of FIGS. 1A and 1B illustrating also the driving means for the feed shaft;

FIG. 6 illustrates in a manner similar to FIG. 2 by vertical section through the feed shaft the manner of coaction between feed shaft and locking pawl;

FIG. 7 is a cross-sectional view of the locking pawl support arrangement of the second embodiment of the invention analogous to the view of FIG. 3;

FIG. 8 is a cross-sectional view through the drive pinion illustrating its cam surfaces;

FIG. 9 is an end elevational view of the locking pawl for the second embodiment of the invention; and FIG. 10 is a side elevational view of the locking pawl of FIG. 9.

DETAILED DESCRIPTION

FIRST EMBODIMENT

Figures 1A, 1B:
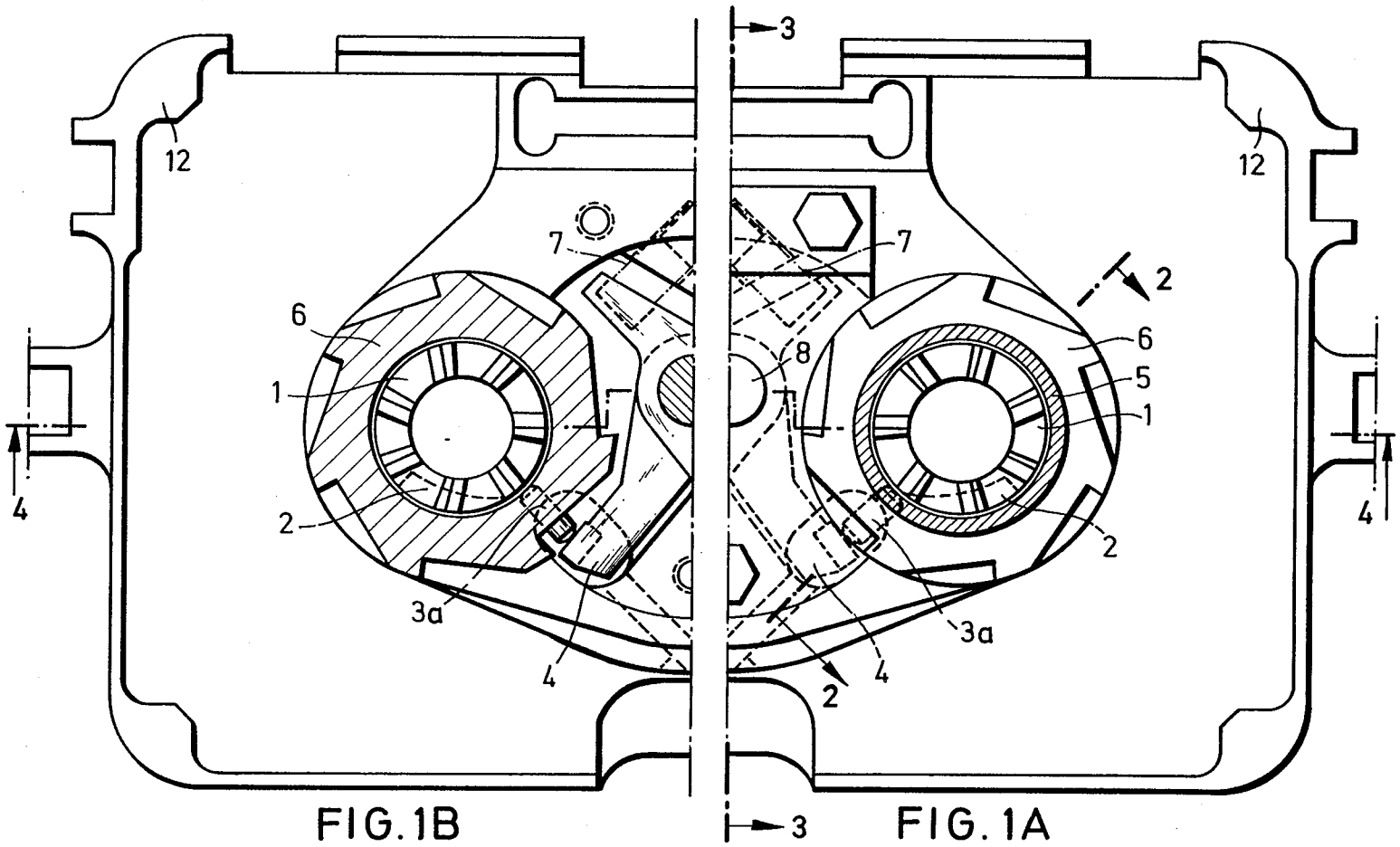
FIG. 1A is a vertical cross-sectional view of the forward end of the right feed shaft.
FIG. 1B is a Vertical partially sectional view of the forward end of the left feed shaft also showing the ratchet wheel rearwardly disposed therefrom.
Figure 2:
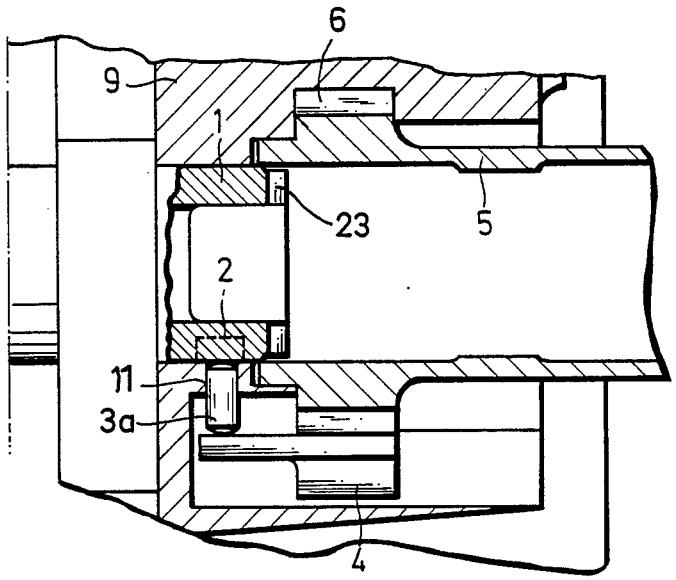

In FIGS. 1A, 1B and 2 there is illustrated on the right side of FIG. 1 the feed shaft 5 with ratched wheel 6 and a pinion wheel 1 mounted thereon which is surrounded by the housing 12. The left ratchet wheel 6 which is displaced somewhat rearwardly relative to the right ratched wheel 6 with respect to the plane of FIGS. 1A and 1B and is also mounted on a drive shaft 5 driving the pinion wheel 1 towards the left that is counter-clockwise.

Each control cam 2 at the pinion 1 coacts with a control pin **3*a* and a locking pawl 4, which locking pawl 4 is rotatably mounted on stationary centrally disposed support shaft 8. Each shorter upper lever arm of the locking pawl 4 is acted on by a coil spring 7, which bears with its other end against the housing 12**.

FIG. 2 illustrates that the control pin **3*a* is mounted and held in a bore 11 of a housing cover 9**.

Figure 3:
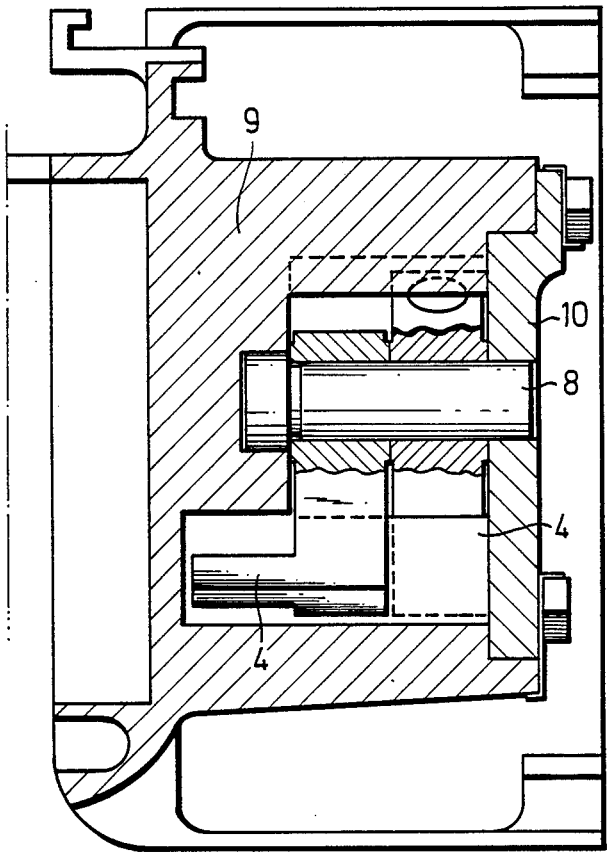

FIG. 3 illustrates the manner of mounting of the shaft 8, in the housing cover 9, which shaft supports the locking pawls 4. The housing cover 9 is closed at its rear end by means of a cover 10 bolted thereon. In order for the locking pawls 4 to be mounted, one behind the other, on the support shaft 8, the sprocket wheels 6 are correspondingly offset on the feed shafts 5 in the axial direction relative to each other.

The functioning of the new brake arrangement can be observed from the drawings. Thus, the drawings illustrate the zero position, in which the control pin 3a is completely pushed out of the drive pinion wheel 1 and thereby also the locking pawl 4 is pivoted about shaft 8 outside of the outer periphery of the sprocket wheel 6.

During rotation of each sprocket wheel 6, as a result of the rotation of the feed shaft 5 and the drive pinion 1, the control pin 3*a* slides along the guide cam surface 2 and is biased towards the drive pinion wheel 1, so that then a lever arm of the locking pawl, as a result of the pressure exerted by its coil spring 7 on the other lever arm, slides into the intermediate space between individual sprocket teeth of the sprocket wheel 6. Thereby the rotation of the wheel 6 is stopped and thereby also the rotation of the feed shaft 5 and the feed shaft star wheel 27 (FIG. 4) stops so that the advancing feed movement of the ammunition belt is stopped. Therefore, at the point in time when the feed shaft 5 is not being driven by the gas piston 25 (FIG. 4) (see also coassigned and copending U.S. Pat. No. 4,416,185 for operation of the gas piston) the looking pawl 4 is taken out of engagement with the sprocket wheel 6, whereas during rotation of the feed shaft 5, that is during feeding of the ammunition belt, the pawl 4 is biased between the sprocket teeth and at the end of rotation is meshed therebetween.

Subsequent thereto, the drive pinion wheel 1, connected with feed shaft 5 via a counter pinion 21 and a coupling 22, is rotatably reversed if necessary with time delay, and pushes thereby the control pin 3*a*, mounted in the bore 11 of the housing cover 9 again into its starting position. The return rotation of the drive pinion 1 is effected by means of return spring 28 mounted in its interior, whereby the teeth 23 of the drive pinion 1 glide over the teeth 24 of the counter pinion 21. This is made possible by the counter pinion 21, as a result of the entraining coupling 22, being axially slidable in the feed shaft 5 but being firmly keyed against counter-rotation. Thus the drive pinion 1 is only firmly connected in such a way with the feed shaft 5 of the ammunition belt feeder that it is entrained, i.e. rotated, in the belt feed direction, whereas in the opposite rotary direction, in view of the arrangement of both pinions 1, 21 and the coupling 22, it is rotatable independently of the rotation of the feed shaft 5. In the illustrated embodiment the pinion 1 and the ratched sprocket wheel 6 each have seven teeth. For feeding a cartridge, there is therefore effected a rotation of 1/7 of 360°. It is of course possible to use a different number of teeth.

SECOND EMBODIMENT

Figure 4:
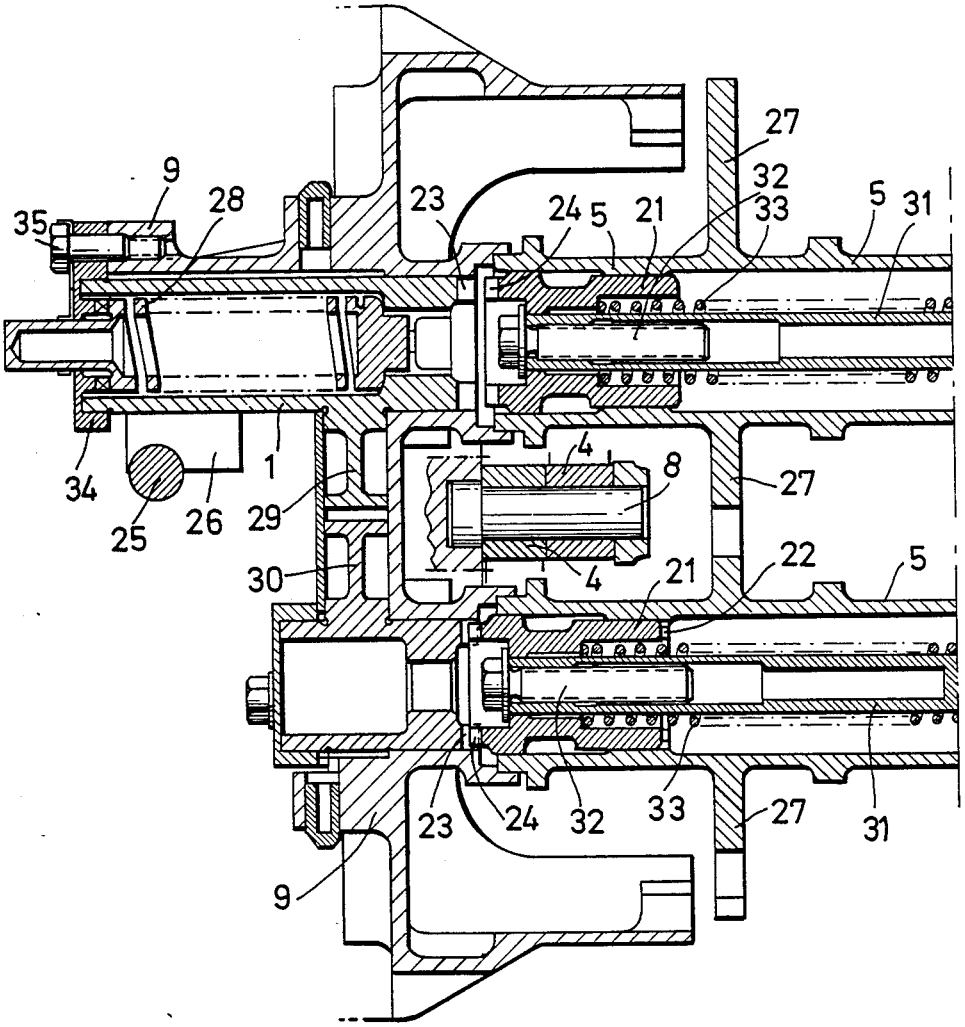
Figure 5B:
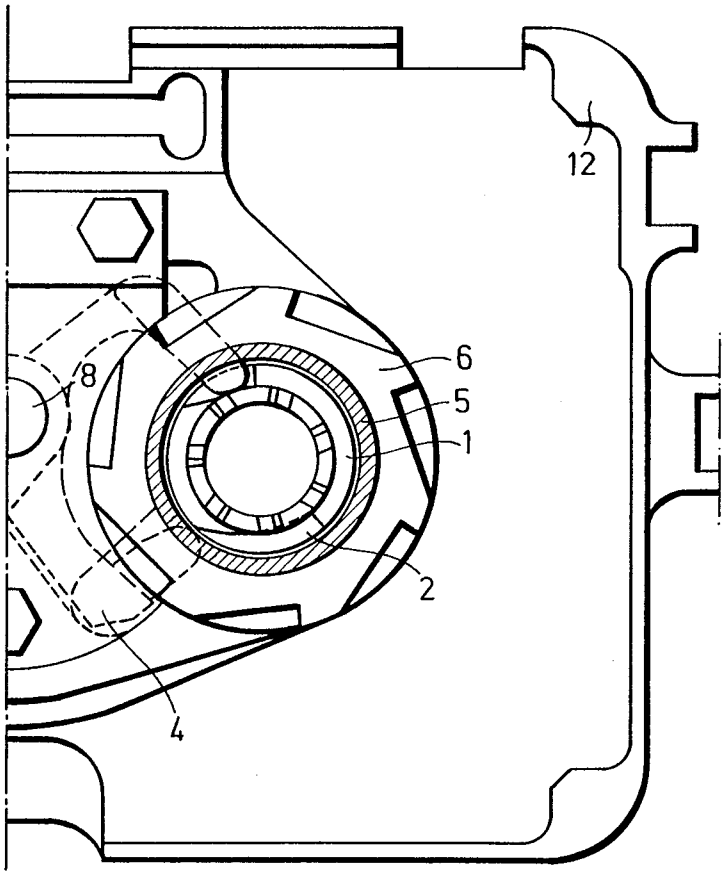
FIG. 5B is a vertical cross-sectional view of the forward end of the right feed shaft of the second embodiment of the invention which corresponds to FIG. 1A.
Figure 5A:
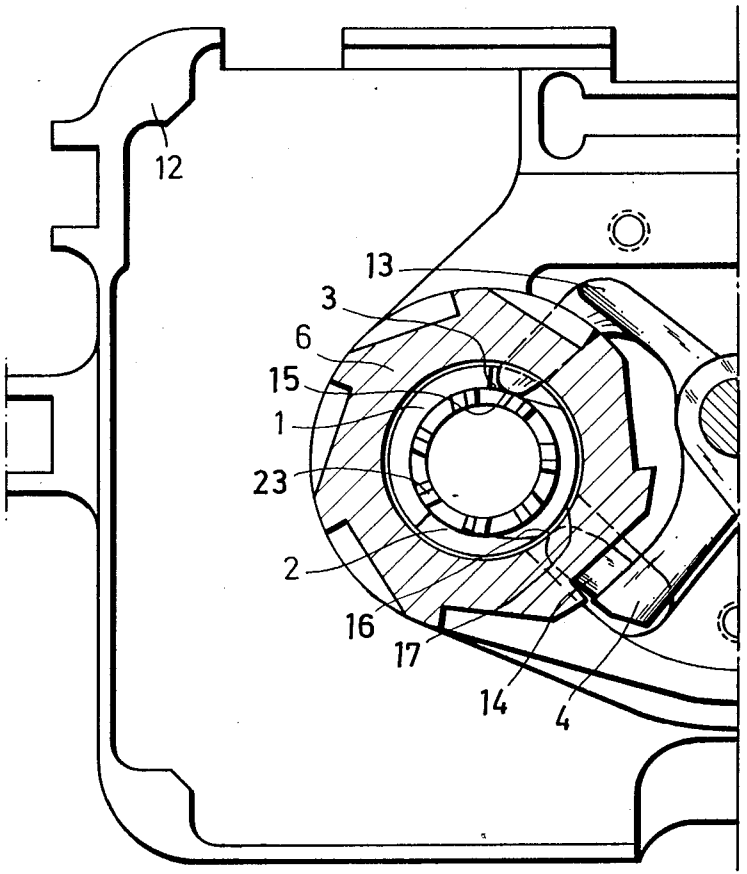
FIG. 5A is a vertical cross-sectional view of the forward end of the left feed shaft of the second embodiment of the invention which corresponds to FIG. 1B.
Figure 6:
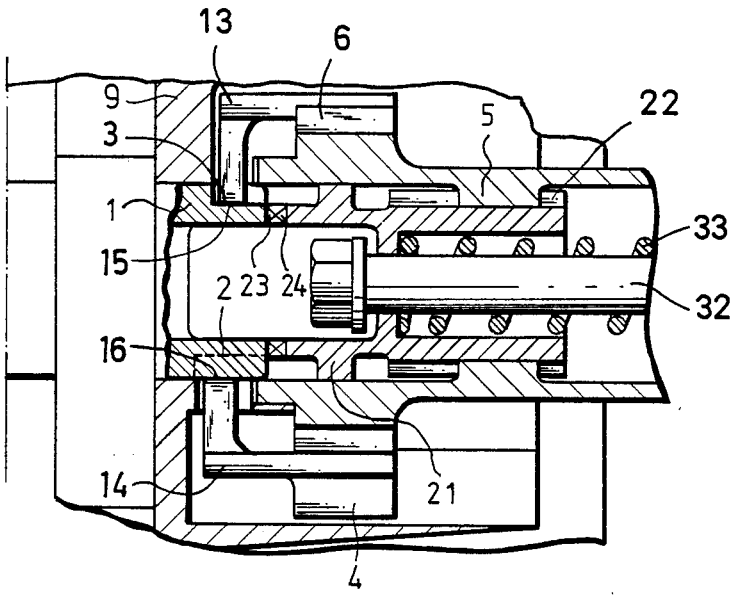

FIGS. 5A, 5B and 6 illustrate how the feed shafts 5 are mounted in the housing 12 (FIG. 5B) and how the ratched wheel 6 and drive pinion 1 are mounted thereon. The right drive pinion 1 is rotatingly driven in a clockwise direction, with respect to the left drive pinion 1 (FIG.5A), whose ratched wheel 6 is disposed somewhat rearwardly of the right drive pinion 1. The ratchet wheels 6 are of unitary construction with respect to the feed shafts 5. The drive pinion 1 is coaxially arranged in front of feed shaft 5, which drives it in a counter clockwise direction. Each control cam 2 on the drive pinion 1 coacts with a lever arm 14 having a contacting glide surface 16 and a lever arm 13 having a contacting glide surface 15 which coact with the locking pawl 4. As can be noted from FIG. 9 the locking pawl 4 has also a ratched point 20. The locking pawls 4 are rotatably mounted by means of their bores 18 on a stationary support shaft 8. As can be noted from FIGS. 4, 5A and 6 each drive pinion 1 is provided at its end face with a plurality of engagement teeth 23 which serve to couple and uncouple the drive pinion 1 with the counter pinion 21.

FIG. 6 illustrates how the lever arm 13 having the glide surface 15 engages in the cam 3, whereas the ratched point 20 (see FIG. 9) of the locking pawl 4 is moved out of way of the ratched surface and the leVer 14 having the glide surface 16 leaves the cam 2. Within the feed shaft 5 there is mounted the axially slidably displacable entraining coupling 22 having the counter pinion 21 and the teeth 24.

Figure 7:
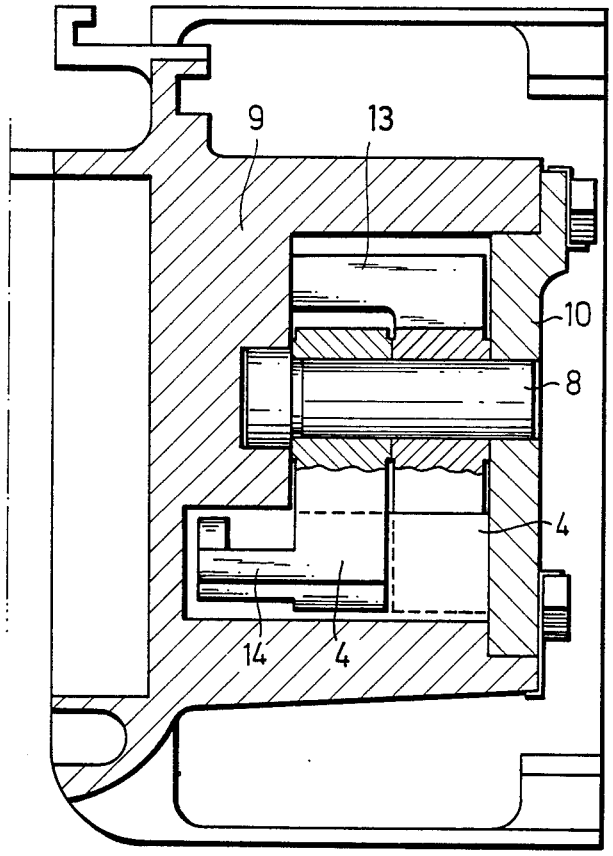

FIG. 7 illustrates the manner of mounting of the shaft 8 which supports the two locking pawls 4 one behind the other in the housing cover 9, which housing cover 9 is rearwardly covered by means of a bolted cover plate 10. In order for the locking pawls to be mounted one behind the other on a support shaft 8, the ratched wheels are axially offset relative to the corresponding feed shafts 5. The lever arms 13 and 14 alternately engage into the control cams 2 and 3 (FIGS. 5A, 5B) which are as a result of the mounting one behind the other shorter at the left locking pawl than at the right one.

Figure 8:
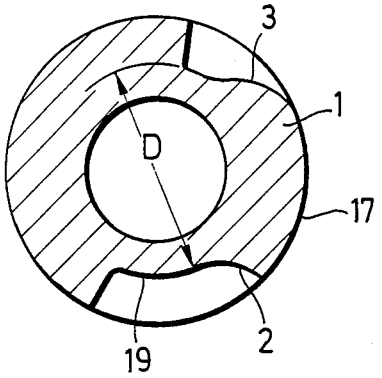

FIG. 8 illustrates the configuration of the control cam 2 and 3 on the drive pinion 1 for controlling the locking pawl 4, whereby cam 2 has a longer slide region 19 on the periphery of the pinion having diameter D than the cam 3. After the locking pawl gliding surfaces 15 and 16 respectively leave the control cams 2 and 3 they alternately glide over the pripheral surface 17 so that thereby the swing region of the lever arm is limited.

Figure 10:
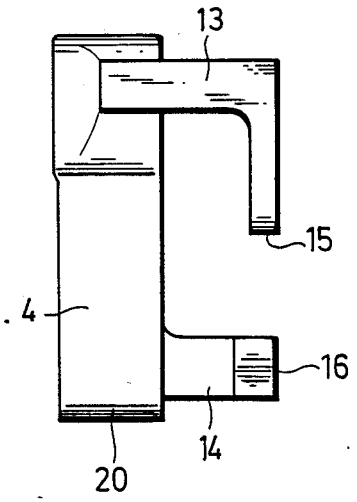
Figure 9:
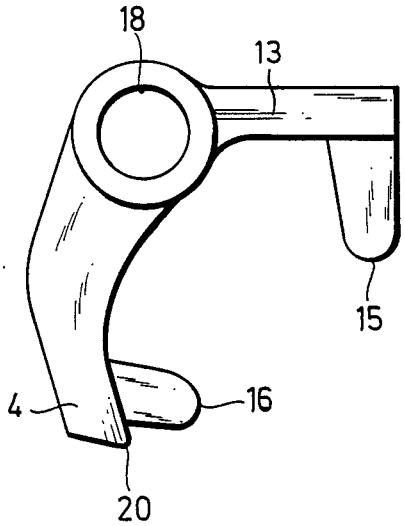

In FIGS. 9 and 10 the locking pawl 4 is shown having the lever arms 13 and 14 arranged thereon. In FIG. 9 the locking pawl is shown in the axial direction with respect to its bore 18 and in FIG. 10 it is shown in a side elevational view in which the manner of projecting of the lever arms 13 and 14 from the main portion of the locking pawl 4 is shown. As can be noted the locking pawl 4 has two circumferentially extending glide surfacés 15 and 16.

of the embodiment of FIGS. 5A, 5B and 6 can be noted from examining the drawings. Thus the drawings illustrate the zero position., in which the lever arm 14 is completely pushed out of the drive pinion 1 and thereby also the locking pawl 4 is pushed out completely from the ratched wheel 6, whereas the lever arm 13 with glide surface 15 is disposed on the cam surface 3. When rotating each ratched wheel 6, in view of the rotation of the feed shaft 5 by the drive pinion 1, by means of the propellant gas emanating from the gun barrel as disclosed in coassigned U.S. Pat. No. 4,416,185.This gas drives the piston 25 as shown in FIG. 4, the glide surface 16 of the lever arm 14 moves, in view of the gliding out of the glide surface 15 of the lever arm 13 from the control cam 3 and the thereby forcible joining of the pivotal movement of the lever arm 14, into the recess of the control cam 2, thereby due to the simultaneous engagement of the locking pawl 4 into the gaps between ratchet teeth of the ratched wheel 6, the rotation of the feed shaft is stopped and thereby the transport wheel 27 as illustrated in FIG. 4 is stopped at the end of the transport motion of the belt ammunition. During its rotation the feed shaft 5 is driven by means of the engagement of the teeth 24 of the counter pinion 21 into the teeth 23 of the drive pinion 1 by means of an entraining coupling 22.

During the return rotation of the drive pinion 1 there results as a result of the sliding along of the glide surface 16 of the lever arm 14 in the glide region 19 of the control cam 2 the disengagement of the locking pawl 4 out of the gaps of the ratched wheel 6 in a time-delayed manner. The return rotation of the drive pinion 1 is effected, as was the case with the embodiment of FIGS. 1 to 4, by means of a return spring 28 arranged in the interior of the drive pinion 1 (FIG. 4).

In the illustrated embodiment the ratched wheel 6 and the pinion 1 have each respectively 7 teeth. For feeding a cartridge there results therefore a rotation of 1/7 of 360° . It is of course understood that other tooth distances and therefore a different number of teeth for the pinion and ratched wheel can be selected.

Although the invention is illustrated and described with reference to a plurality of preferred embodiments thereof, it is to be expressly understood that it is in no way limited to the disclosure of such preferred embodiments, but is capable of numerous modifications within the scope of the appended claims.

We claim:

1. In an ammunition belt advancing device for a machine cannon of the type wherein cartridges are alternatively fed from one of two sides into a loading chamber by means of two feed star wheels respectively mounted on two feed shafts, each star wheel engaging one ammunition belt, which belt advancing device is driven by a gas piston which is actuated by branched off propulsion gas, a recoil brake mechanism, comprising in combination.

a sprocket wheel having a plurality of uniformly peripherally spaced sprocket teeth being coaxially mounted on each feed shaft, a pair of two-armed locking pawls pivotally mounted in the device, each locking pawl coacting with a sprocket wheel;

biasing means operatively connected to one arm of each pawl to thereby urge the other arm of each pawl toward its respective sprocket wheel, a pinion coaxially operatively mounted on each feed shaft;

cam means disposed on each pinion and adapted to coact with said other arm of the locking pawl;

whereby said cam means are operatively connected to said other arm so as to urge it out of the space between the sprocket teeth of the sprocket wheel to permit its unhindered rotation, at the point in time when the corresponding feed shaft is not driven by the gas piston, whereas during the rotation of the feed shaft, that is during the ammunition belt feeding operation, the other arm of the locking pawl is biased between the sprocket teeth and engages therebetween at the end of the step-wise rotation of the feed shaft; said biasing means include a control pin which is slidably mounted in the device and is disposed between said cam means and said other arm of said locking pawl, said biasing means further include a coil spring, said locking pawl is in the form of a two-armed lever, one arm of which is in contact with said coil spring and the other arm is in contact with said control pin.

2. The improvement in an ammunition belt feeding device for an automatic weapon, as defined in claim 1, wherein both locking pawls are pivotally mounted on a common support shaft which is mounted in said device midway between said two feed shafts.

3. The improvement in an ammuniton belt feeding device for an automatic weapon, as defined in claim 2, wherein said biasing means include a glide surface respectively disposed at the free end of each arm of said two-armed locking pawl, at least two separate cam surfaces on said cam means on each pinion, the glide surface of a first arm of the locking pawl positively glidingly contacting a peripheral surface of said cam and the glide surface of the second arm of the locking pawl positively glidingly contacting a first cam surface of said cam means while said other arm of said locking pawl projects betWeen two adjacent sprocket teeth of the sprocket wheel, while when said other arm of said locking pawl does not project between the adjacent sprocket teeth the glide surface of the second arm glidingly contacts said peripheral surface of said cam means and the glide surface of said first arm glidingly contacts the second cam surface of said cam means.

4. The improvement in an ammunition belt feeding device for an automatic weapon, as defined in claim 3, wherein said first and second cam surfaces have different configurations and wherein said first and second cam surfaces have respective gliding surfaces disposed at substantially equal radial distances from the axis of said cam means, the gliding surface of said first cam surface being substantially longer than the gliding surface of the second cam surface.

5. The improvement in an ammunition belt feeding device for an automatic weapon, as defined in claim 4, wherein said locking pawl includes a hub portion, said two cams of said locking pawl being integral with and extending substantially radially outwardly from said hub portion and being angularly spaced from each other less then 180°, said glide surfaces of said first and second arms of said locking acting on parallel planes.

6. The improvement in an ammuniton belt feeding device for an automatic weapon, as defined in clain 5, wherein said first and second glide surfaces of said locking pawl, said peripheral surface and first and second cam surfaces of said cam means and a free contact edge on the second arm of the locking pawl are all made of wear resistant material.

* * * * *

UNITED STATES PATENT AND TRADEMARK OFFICE

CERTIFICATE OF CORRECTION

PATENT NO. : 4,932,307

DATED : June 12, 1990

INVENTOR(S) : Horst MENGES and Norbert SCHENK

It is certified that error appears in the above-identified patent and that said Letters Patent is hereby corrected as shown below:

Cover page, immediately following item [76], insert the name and address of the Assignee as follows --Rheinmetall GmbH, Federal Republic of Germany--.

Signed and Sealed this

First Day of October, 1991

*Attest:*

*Attesting Officer*

HARRY F. MANBECK, JR.

*Commissioner of Patents and Trademarks*